US006948689B2

(12) United States Patent
Kenney

(10) Patent No.: US 6,948,689 B2
(45) Date of Patent: Sep. 27, 2005

(54) PORTABLE APPARATUS FOR DEMARCATING A REGION WITH RESPECT TO THE GROUND

(76) Inventor: Gregory M. Kenney, 17W712 Butterfield Rd., Oakbrook Terrace, IL (US) 60181

( * ) Notice: Subject to any disclaimer, the term of this patent is extended or adjusted under 35 U.S.C. 154(b) by 0 days.

(21) Appl. No.: 10/178,677

(22) Filed: Jun. 24, 2002

(65) Prior Publication Data

US 2003/0234334 A1 Dec. 25, 2003

(51) Int. Cl.[7] ..... A47B 96/06
(52) U.S. Cl. ..... 248/218.4
(58) Field of Search ..... 248/507, 508, 248/530, 535, 533, 156

(56) References Cited

U.S. PATENT DOCUMENTS

| | | | | | |
|---|---|---|---|---|---|
| 219,080 | A | * | 9/1879 | Edwards | 294/152 |
| 4,218,059 | A | | 8/1980 | Eiden | 273/25 |
| 4,319,428 | A | * | 3/1982 | Fox | 47/42 |
| 4,429,872 | A | | 2/1984 | Capachi | 273/25 |
| 4,520,985 | A | * | 6/1985 | Blumenthal | 248/530 |
| 4,787,601 | A | * | 11/1988 | Rybak | 256/19 |
| 4,880,243 | A | | 11/1989 | Raub | 273/411 |
| 5,067,683 | A | * | 11/1991 | Wager | 248/545 |
| 5,085,409 | A | * | 2/1992 | Teixeira | 256/48 |
| 5,130,954 | A | * | 7/1992 | Fussell | 367/188 |
| 5,181,335 | A | * | 1/1993 | Todd | 40/607 |
| 5,247,900 | A | * | 9/1993 | Sobczak | 116/209 |
| 5,285,195 | A | * | 2/1994 | Way et al. | 340/654 |
| 5,487,402 | A | | 1/1996 | Clary | 135/87 |
| 5,492,294 | A | * | 2/1996 | Haeussler | 248/229.1 |
| 5,502,910 | A | * | 4/1996 | Lucchesi | 40/606 |
| 5,709,057 | A | * | 1/1998 | Johnson et al. | 52/301 |
| 5,749,386 | A | * | 5/1998 | Samuel, Jr. | 135/16 |
| 5,881,495 | A | * | 3/1999 | Clark | 47/48.5 |
| 6,010,416 | A | * | 1/2000 | Frederick | 473/490 |
| 6,131,885 | A | * | 10/2000 | Berg et al. | 256/19 |
| 6,149,135 | A | * | 11/2000 | Hlavin | 256/24 |
| 6,213,314 | B1 | | 4/2001 | Beemer | 211/70.6 |
| 6,527,246 | B1 | * | 3/2003 | Stinnett | 248/545 |
| 2002/0027225 | A1 | * | 3/2002 | Sotillos et al. | 256/67 |
| 2003/0021108 | A1 | * | 1/2003 | Winther | 362/153 |

* cited by examiner

*Primary Examiner*—Leslie A. Braun
*Assistant Examiner*—A. Joseph Wujciak
(74) *Attorney, Agent, or Firm*—Wallenstein Wagner & Rockey, Ltd.

(57) ABSTRACT

A portable apparatus for demarcating a region with respect to the ground comprising a plurality of posts adapted to be removably inserted into the ground. The apparatus further comprises an adjustable connecting means which is secured by a receiving member in an upper portion of the post. A pedestal extends radially from a lower portion of the post. The pedestal is adapted to facilitate the removable insertion of the post. At least one pennant depends from the connecting means. The connection between the posts and the connecting means defines an adjustable border region or perimeter wherein the connection means, the posts, and/or the pennants are elevated above the ground and are thereby highly visible.

4 Claims, 10 Drawing Sheets

PORTABLE APPARATUS FOR DEMARCATING A REGION WITH RESPECT TO THE GROUND

TECHNICAL FIELD

The present invention relates to a portable apparatus for demarcating a region of the ground. Specifically, the present invention concerns an apparatus for defining and establishing temporary or semi-permanent boundaries with respect to the ground.

BACKGROUND OF INVENTION

Heretofore, there has been no simple, economical, or portable apparatus to demarcate an area of the ground. One traditional demarcation apparatus is a fence. A fence can demarcate or establish a border which may have a regular or irregular shape; however, the installation of a fence requires significant investments of time and effort as well as specific tools. Erecting a fence is time consuming and typically done once. Fences, once installed, are generally permanent and entirely not portable. Fence posts and the wire mesh used to connect them are thick and heavy and are not designed to be removed, transported, and reinstalled in other locations.

Various apparatus and methods have also been used for establishing a sport playing area, including U.S. Pat. No. 4,218,059 to Eiden, which relates to field markers imbedded into the ground as a more permanent demarcation. U.S. Pat. No. 4,429,872 to Capachi describes another boundary apparatus permanently imbedded in the ground.

U.S. Pat. No. 4,880,243 to Raub describes a portable apparatus that marks the bounds of a rectangular playing court having a predetermined perimeter. Methods and apparatus for marking the boundaries of sport playing areas, whether permanent or removable, suggest a need for adhering to a standard, non-adjustable or "regulation" sized region.

The above references have the significant disadvantages of either large and non-portable boundary markers or a relative lack of visibility of the demarcation apparatuses that lay flat on the ground. These sport playing area boundary markers tend to create a large perimeter with a standard size and shape that cannot be altered to meet different demarcation needs. Also, they do not have the advantages of easy installation and removal. Additionally, conventional devices are cumbersome and suffer from a lack of portability. Finally, many of the sport field boundaries rest directly on the ground. The fact that they rest on the surface of the ground reduces the border visibility from both within and beyond the marked area.

This invention is directed to solve these and other limitations.

SUMMARY OF THE INVENTION

The present invention relates to a portable apparatus for demarcating a region. The portable demarcating apparatus comprises a plurality of posts, means for connecting the posts, and at least one pennant depending from the connecting means. The combination of the posts, the connecting means, and the pennants demarcate or establish a boundary region with respect to the ground G. In other words, the posts and the connecting means establish a highly-visible perimeter P. As a result, the perimeter P is visible from two locations—from within the perimeter P and from beyond the perimeter P—which increases the versatility and utility of the portable apparatus.

The post has an upper portion, an intermediate portion, and a lower portion. The post is adapted to be removably inserted in the ground G, meaning that the post can be repeatedly positioned in and removed from the ground G. The upper portion terminates at a cap or cover. A receiving member adapted to receive a portion of the connecting means is preferably positioned in the upper portion. Alternatively, the receiving member extends from the intermediate portion of the post.

A pedestal extends radially from an outer surface of the post. Described in different terms, the pedestal extends generally perpendicular to a longitudinal axis A—A of the post. The pedestal is adapted to facilitate the removable insertion of the post. Preferably, the pedestal is positioned between the intermediate and lower portions thus the pedestal divides the intermediate and lower portions. Alternatively, the pedestal is positioned between the upper and intermediate portions. Preferably, the pedestal is integral to the post, meaning molded to the post. Alternatively, the pedestal is hingeably connected to the post, or affixed to the post with a connector.

To insert the post into the ground G, an operator applies a generally downward force Fd to an upper surface of the pedestal. A sufficient amount of force Fd is applied to the pedestal until the pedestal is positioned adjacent the ground G and the lower portion extends into the ground G. At this position, the post defines a first or use position P1. In the use position P1, the pedestal and the lower portion are in direct contact with the ground G thereby increasing the stability of the post and preventing undesirable wavering of the post. To remove the post from the use position P1, an operator can apply an upwardly directed force on the cap. Also, an operator can apply an upwardly directed force on the pedestal. Or, an operator can apply force in a direction generally transverse to the post at the upper portion and/or intermediate portion to "pry" the post out of the ground G.

In the use position P1 and in contrast to conventional apparatus, the intermediate and upper portions are positioned above the ground G thereby increasing the visibility of the post. In the use position P1, the receiving member and the connecting means are both elevated above the ground G thereby increasing the visibility of the connecting means, the pennants, and the perimeter P.

The connecting means is releasably attached or affixed to the receiving member of each post to form a perimeter P. Preferably, the connecting means is flexible such that a plurality of posts can be connected or joined to form the perimeter P. Described in different terms, the connecting means 14 links the posts to form either a linear or non-linear boundary region. Because the connecting means is flexible, the perimeter P can have a wide variety of configurations, including but not limited to rectangular, circular, square, or elliptical.

In another preferred embodiment, the receiving member is omitted from the post and the cap has a recess adapted to receive either a portion of the connecting means or the ends of the connecting means. In this manner, the connecting means is affixed directly to the cap. The recess can be molded or formed into the cap. The recess can include at least one notch adapted to retain the connecting means in the recess.

In another preferred embodiment, the post has a retractable receiving member in the cap. An actuator is operably connected to the receiving member to raise and lower the member between an open and closed position. In the open position, the receiving member is elevated a distance above the cap and as a result, is capable of receiving a portion of the connecting means. In the closed position, the receiving member secures a portion of the connecting member against the cap. A spring (not shown) can be utilized to bias the receiving member to either the open or closed position.

In another preferred embodiment, the post has a two-piece cap. The cap comprises a cover portion and a base portion that are adapted to be separable from an open position to a closed position. Described in different terms, the cover is removably received by the base. The cover portion has a rounded top wall, an annular intermediate wall, and an annular bottom wall. Preferably, two apertures form an internal passageway in the intermediate and bottom walls. Alternatively, the aperture is positioned in an annular side wall of the base and as a result, the internal passageway is formed in the base. The internal passageway is adapted to receive a portion of the connecting means. In the open position, the cap is capable of receiving a portion of the connecting means. In the closed position, the cover and the base engage to secure a portion of the connecting means in the internal passageway.

In another preferred embodiment, the post has a two-piece design with a separation point between the intermediate portion and the lower portion. A projection extends from one of the intermediate portion or the lower portion, and a receiver is positioned in the other of the intermediate portion or the lower portion. The projection is adapted to be removably inserted in the receiver. Preferably, the receiver receives the entire length of the projection to ensure the structural integrity of the post. Alternatively, the receiver accommodates a substantial extent of the length of the projection. The pedestal can extend from either the lower portion or the intermediate portion depending upon design parameters of the post.

In another preferred embodiment, the post has a two-piece design wherein the intermediate portion receives an extent of the lower portion. Described in different terms, the intermediate and lower portions are cooperatively dimensioned such that the lower portion is removably inserted in the intermediate portion. Alternatively, the intermediate and lower portions are cooperatively dimensioned such that the intermediate portion is removably inserted in the lower portion. The lower portion has at least one detent which engages a recess in the intermediate portion.

The present invention is generally light weight and can be stored and transported in a small bag. Accordingly, the present invention is highly portable. As a result, the versatility and utility of the invention are increased.

Other advantages and aspects of the present invention will become apparent upon reading the following description of the drawings and detailed description of the invention.

DETAILED DESCRIPTION

Figure 1:
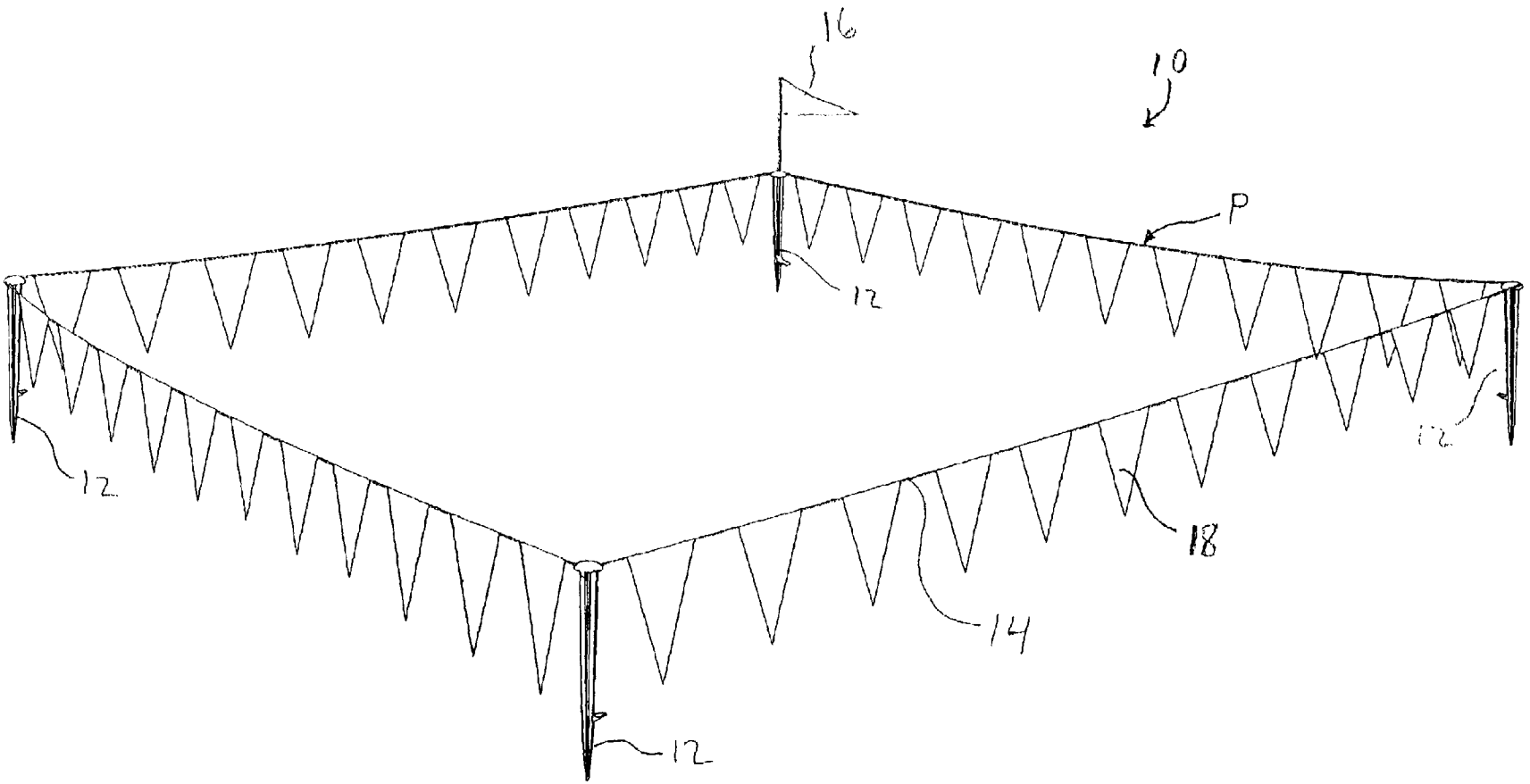
FIG. 1 is a perspective view of the portable demarcating apparatus of the invention showing a plurality of posts connected by the connecting means having a plurality of pennants.

While this invention is susceptible of embodiments in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiment illustrated. Similar elements in alternate embodiments will be referred to with like reference numerals.

The present invention relates to a portable apparatus 10 for demarcating a region. As shown in FIG. 1, the portable demarcating apparatus 10 comprises a plurality of posts 12 and means for connecting the posts 14. As described below, the posts 12 and the connecting means 14 demarcate or establish a boundary region with respect to the ground G. In other words, the posts 12 and the connecting means 14 establish a highly-visible perimeter P. As a result, the perimeter P is visible from two locations—from within the perimeter P and from beyond the perimeter P—which increases the versatility and utility of the portable apparatus 10. A flag 16 can extend from a post 12 to further increase the visibility of the apparatus 10. In addition, at least one triangular-shaped pennant 18 can depend from the connecting means 14. Although shown as having a triangular configuration, the pennant 18 can have a variety of configurations such as oval, rectangular or elliptical.

Figure 2:
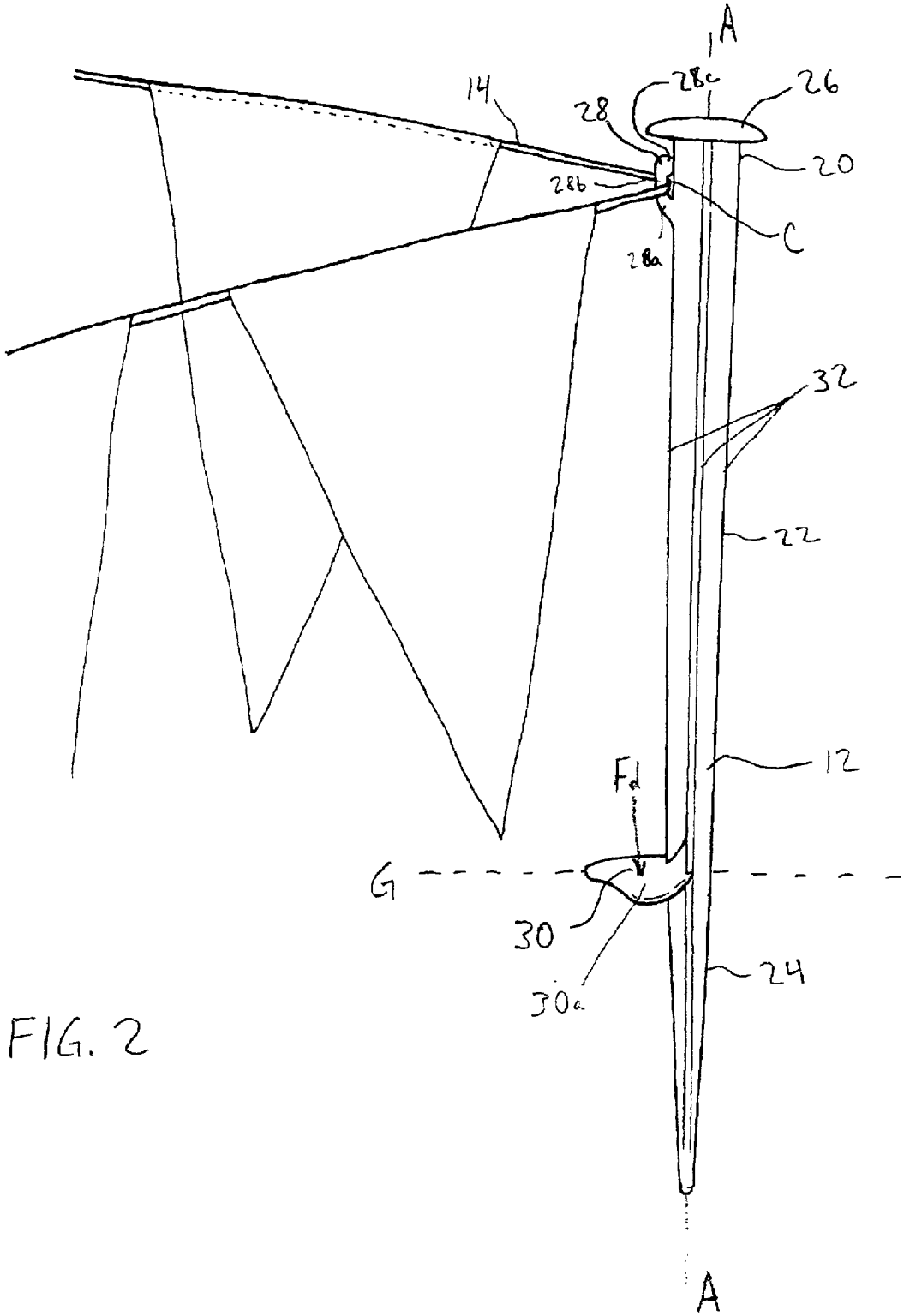
FIG. 2 is a perspective view of the apparatus of FIG. 1, showing the connecting means secured to a single post.

Referring to FIG. 2, the post 12 has an upper portion 20, an intermediate portion 22, and a lower portion 24. The post 12 is adapted to be removably inserted in the ground G, meaning that the post 12 can be repeatedly positioned in and removed from the ground G. The upper portion 20 terminates at a cap or cover 26. The cap 26 can have a bulbous or generally flat configuration. A receiving member 28 adapted to receive a portion of the connecting means 14 is preferably positioned in the upper portion 20. The receiving member 28 has a first segment 28*a* that extends radially outward from the upper portion 20 and a second segment 28*b* that extends generally transverse from the first segment 28*a*. The receiving member 28, including the first and second segments 28*a,b*, define a gap or clearance C that is positioned between the receiving member 28 and the upper portion 20. A bulb 28*c*, adjacent to the second segment 28*b*, is adapted to secure the connecting means 14 within the clearance C. Alternatively, the receiving member 28 extends from the intermediate portion 22 of the post 12.

A pedestal 30 extends radially from an outer surface of the post 12. Described in different terms, the pedestal 30 extends generally perpendicular to a longitudinal axis A—A of the post 12. The pedestal 30 is adapted to facilitate the removable insertion of the post 12. Preferably, the pedestal 30 is positioned between the intermediate and lower portions 22, 24, thus the pedestal 30 divides the intermediate and lower portions 22, 24. Alternatively, the pedestal 30 is positioned between the upper and intermediate portions 20, 22. Preferably, the pedestal 30 is integral to the post 12, meaning its forming during the molding process of the post 12. Alternatively, the pedestal 30 is hingeably connected to the post 12, or affixed to the post 12 with a connector. To aid the removable insertion, the post 12 has at least one spine 32 such that the post 12 has a "t-shaped" cross-section. The spines 32 are further adapted to increase the structural rigidity of the post 12. However, the configuration of the post 12 can vary. For example, the post 12 can have a round or tubular configuration. The dimensions of the post 12 can vary with the design parameters of the demarcating apparatus 10. For example, the post 12 can have a length from 12 to 30 inches and the diameter of the post 12 can range from 0.5 to 2.0 inches. Also, the ratio of the length of the upper and intermediate portions 20, 22 versus the lower portion 24 should be approximately 3:1.

Referring to FIG. 2, to insert the post 12 into the ground G, an operator applies a generally downward force Fd to an upper surface 30*a* of the pedestal 30. A sufficient amount of force Fd is applied to the pedestal 30 until the pedestal 30 is positioned adjacent the ground G and the lower portion 24 extends into the ground G. At this position, the post 12 defines a first or use position P1. In the use position P1, the pedestal 30 and the lower portion 24 are in direct contact with the ground G thereby increasing the stability of the post 12 and preventing undesirable wavering of the post 12. Alternatively, the pedestal 30 can be omitted from the post 12 and a downward force can be applied to the cap 26 to drive the post 12 into the ground G and into the use position P1. To remove the post 12 from the use position P1, an operator can apply an upwardly directed force on the cap 26. Also, an operator can apply an upwardly directed force on the pedestal 30. Or, an operator can apply force in a direction generally transverse to the longitudinal axis A—A of the post 12 at the upper portion 20 and/or intermediate portion 22 to pry or loosen the post 12 from the ground G. In this manner, the portions 20, 22 are used as a lever and the pedestal 30 is used as a fulcrum.

In the use position P1 and in contrast to conventional apparatus, the intermediate and upper portions 20, 22 are positioned above the ground G thereby increasing the visibility of the post 12. In the use position P1, the receiving member 28 and the connecting means 14 are both elevated above the ground G thereby increasing the visibility of the connecting means 14, the pennants 18, and the perimeter P. This is a significant distinction over a conventional apparatus that is merely placed on the ground. For example, conventional apparatuses used to establish the boundaries of a playing field, i.e. football, soccer, field hockey, suffer from extremely poor visibility and are prone to being stepped on and damaged. Similarly, conventional apparatuses used for leisure activities, i.e. concerts and outdoor exhibitions, suffer from the same limitations.

As discussed above, the apparatus 10 further comprises means for connecting the posts 12. The connecting means 14 is releasably attached or affixed to the receiving member 28 of each post 12 to form the perimeter P. For example, when the apparatus 10 includes four posts 12, the connecting means 14 is attached to each of the four posts 12 at their respective receiving member 28. Therefore, there are four connection points between the posts 12 and the connecting means 14. Preferably, the connecting means 14 is flexible such that a plurality of posts 12 can be connected or joined to form the perimeter P. Described in different terms, the connecting means 14 links the posts 12 to form either a linear or non-linear boundary region. The connecting means 14 can be rope, twine, elastic or a plastic-based element. Because the connecting means 14 is flexible, the perimeter P can have a wide variety of configurations, including but not limited to rectangular, circular, square, or elliptical.

Figure 3:
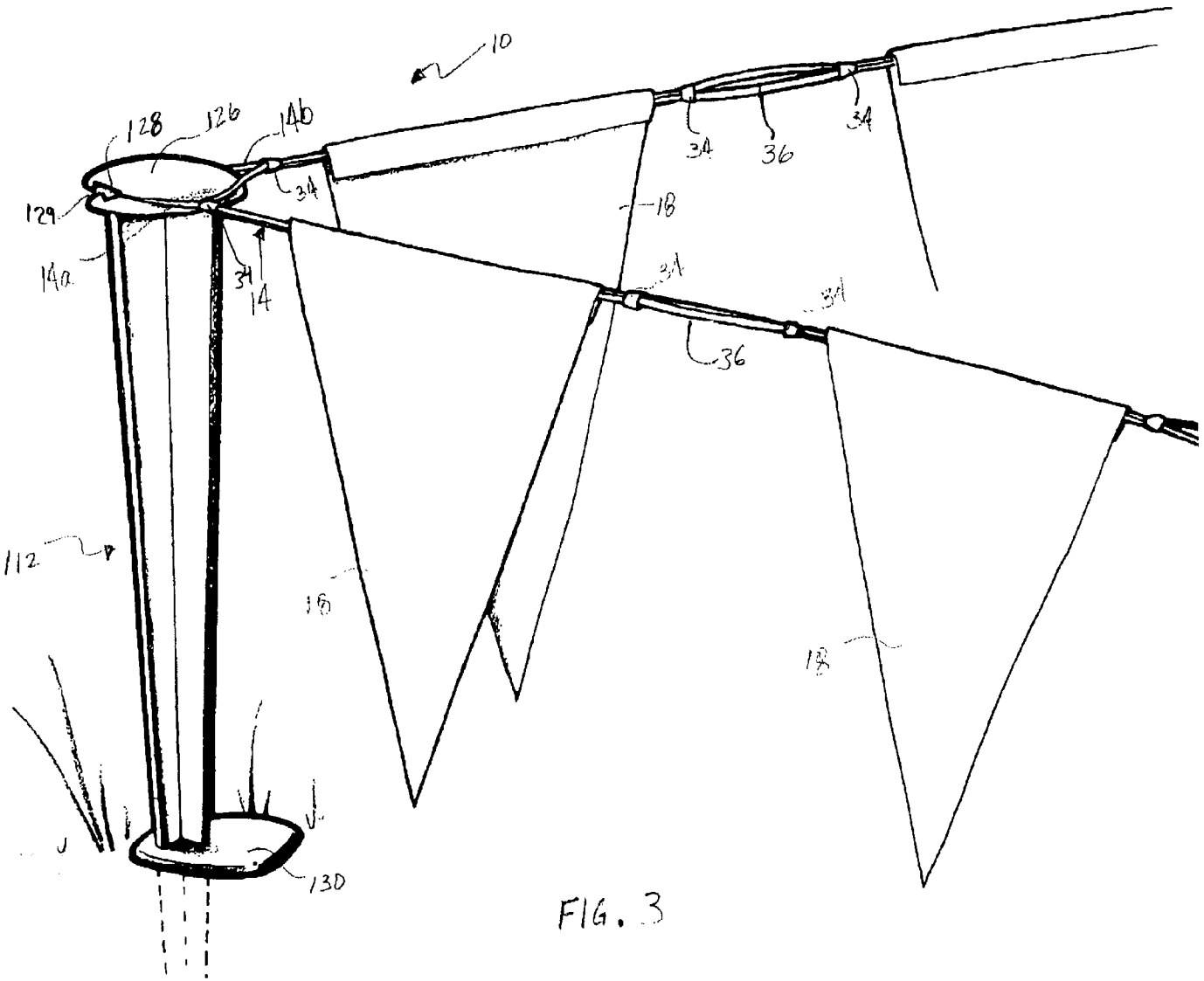
FIG. 3 is a perspective view of an alternate embodiment of the invention, showing an alternate post and connecting means.

FIG. 3 shows the connecting means 14 secured to an alternate post 112. There, the connecting means 14 preferably has a first end 14*a* and a second end 14*b* secured to common post 112. In addition, the connecting means 14 has at least one adjustment element 34 that is adapted to alter or vary the length of the connecting means 14. The connecting means 14 has an overall length L. Alternatively, the connecting means 14 may be secured to a post 112 at a position along the length L of the connecting means 14. In the event that the posts 112 are arranged in configuration with a perimeter less than the overall length L of the connecting means 14, the adjustment elements 34 are utilized to reduce the overall length of the connecting means 14. Accordingly, the connecting means 14 can then be used to link the posts 112. When the adjustment elements 34 are utilized to reduce the overall length L of the connecting means 14, an excess portion 36 of the connecting means 14 results. The adjustment element 34 can be a brad, clip, pin, or any element capable of reducing the excess length of the connecting means 14. Alternatively, the connecting means 14 is a continuous loop without a first or second end 14*a,b*. As described above, the adjustment elements 34 can be used to reduce the dimensions of the looped connecting means 14. At least one pennant 18 depends from a portion of the connecting means 14. The pennant 18 can be secured to the connecting means 14 in a number of ways, including but not limited to hook and pile connector, snaps, buttons, and permanent or semi-permanent adhesive.

As shown in FIG. 3, the cap 126 has a recess 128 adapted to receive either a portion of the connecting means 14 or the ends 14*a,b*, of the connecting means 14. In this manner, the connecting means 14 is affixed directly to the cap 126. The recess 128 can be molded or formed into the cap 126. The recess 128 can include at least one notch 129 adapted to retain the connecting means 14 in the recess 128. The configuration and dimensions of the recess 128 can vary with the design parameters of the post 112 and the size and configuration of the connecting means 14.

Figure 4A:
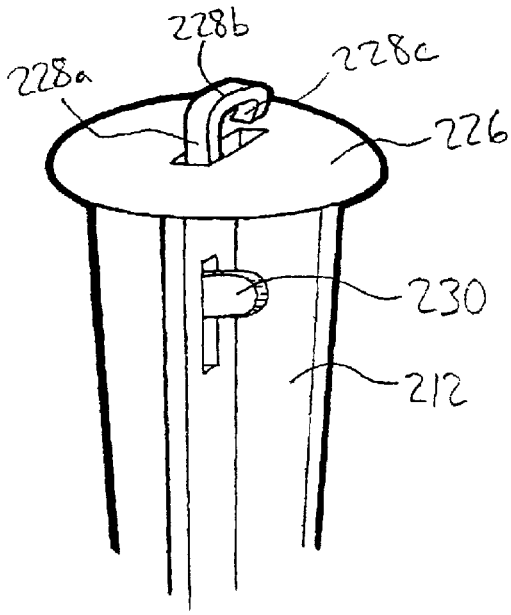
FIG. 4*a* is a perspective view of an alternate embodiment of the invention, showing an alternate post.
Figure 4B:
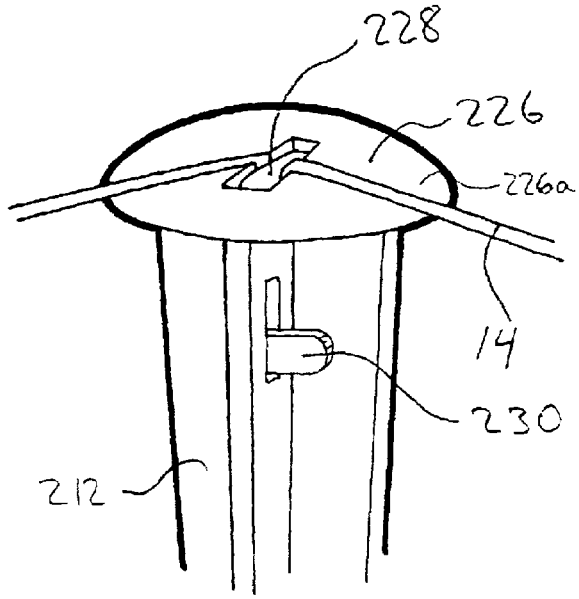
FIG. 4*b* is a perspective view of the embodiment of FIG. 4*a*, showing the connecting means secured to the alternate post.

In another preferred embodiment shown in FIGS. 4*a,b*, the post 212 has a retractable receiving member 228 in the cap 226. An actuator 230 is operably connected to the receiving member 228 to raise and lower the member 228 between an open and closed position. In the open position, the receiving member 228 is capable of receiving a portion of the connecting means 14. In the closed position, the receiving member 228 secures the connecting means 14 to the cap 226 of the post 212. The receiving member 228 has a first portion 228*a* extending generally perpendicular to the cap 226, a second portion 228*b* extending generally transverse to the first portion 228*a*, and a third portion 228*c* extending generally transverse to the second portion 228*b*. As a result, the receiving member 228 has a "J-shaped" configuration. In the open position of FIG. 4*a*, the receiving member 228 is elevated a distance above the cap 226 and as a result, is capable of receiving a portion of the connecting means 14. In the closed position of FIG. 4*b*, the receiving member 228 secures a portion of the connecting member 14 against the cap 226. In the closed position, the receiving member 228 can be positioned below an upper surface 226*a* of the cap 226 or flush with the surface 226*a*. A spring (not shown) can be utilized to bias the receiving member 228 to either the open or closed position.

Figure 5B:
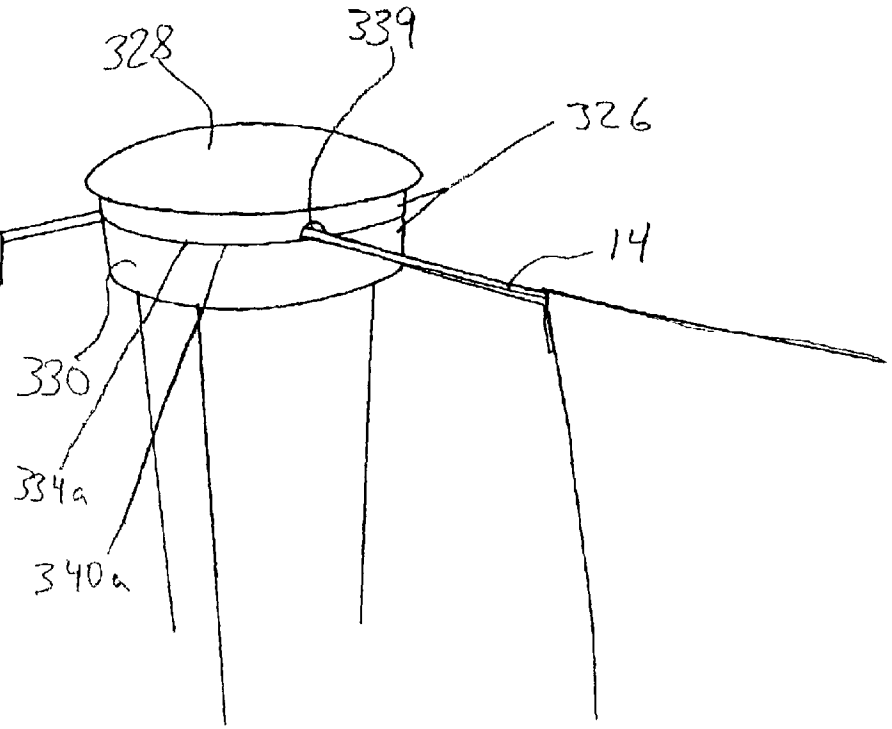
FIG. 5*b* is a perspective view of the embodiment of FIG. 5*a*, showing the connecting means secured to the alternate post.
Figure 5A:
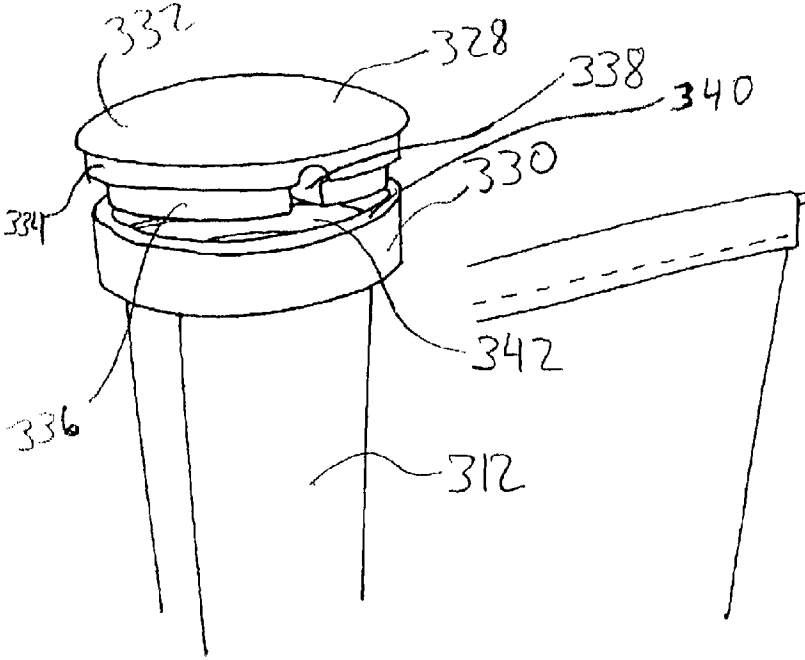
FIG. 5*a* is a perspective view of an alternate embodiment of the invention, showing an alternate post.

In another preferred embodiment shown in FIGS. 5*a,b*, the post 312 has a two-piece cap 326. The cap 326 comprises a cover portion 328 and a base portion 330 that are adapted to be separable or moveable between an open position and a closed position. Described in different terms, the cover 328 is removably received by the base 330. The cover portion 328 has a rounded top wall 332, an annular intermediate wall 334, and an annular bottom wall 336. Preferably, two apertures 338 form an internal passageway 339 in the intermediate and bottom walls 334, 336. Alternatively, the aperture 338 is positioned in an annular side wall 340 of the base 330 to form an internal passageway 339 in the base 330. The apertures 338 are spaced roughly 90 degrees apart, however, that orientation can vary with the design parameters of the post 312. The internal passageway 339 is adapted to receive a portion of the connecting means 14. The base 330 has an annular side wall 340 defining an opening 342 adapted to receive a portion of the cover 328, preferably the bottom wall 336. In the open position of FIG. 5*a*, the cap 326 is capable of receiving a portion of the connecting means 14. In the closed position of FIG. 5*b*, the cover 328 and the base 330 engage to secure a portion of the connecting means 14 in the internal passageway 339. Specifically, a portion of the connecting means 14 is secured within the internal passageway 339 of the cover 328. In the closed position, an edge 334*a* of the intermediate wall 334 is adjacent to an edge 340*a* of the bottom wall 340. An affixing element (not shown) can be utilized to affix the cover 328 to the base 330 in the closed position. For example, a plurality of notches or detents can be formed in either the cover 328 or the base 330. Alternatively, the cover 328 and the base 330 are dimensioned for a press fit engagement.

Figure 6:
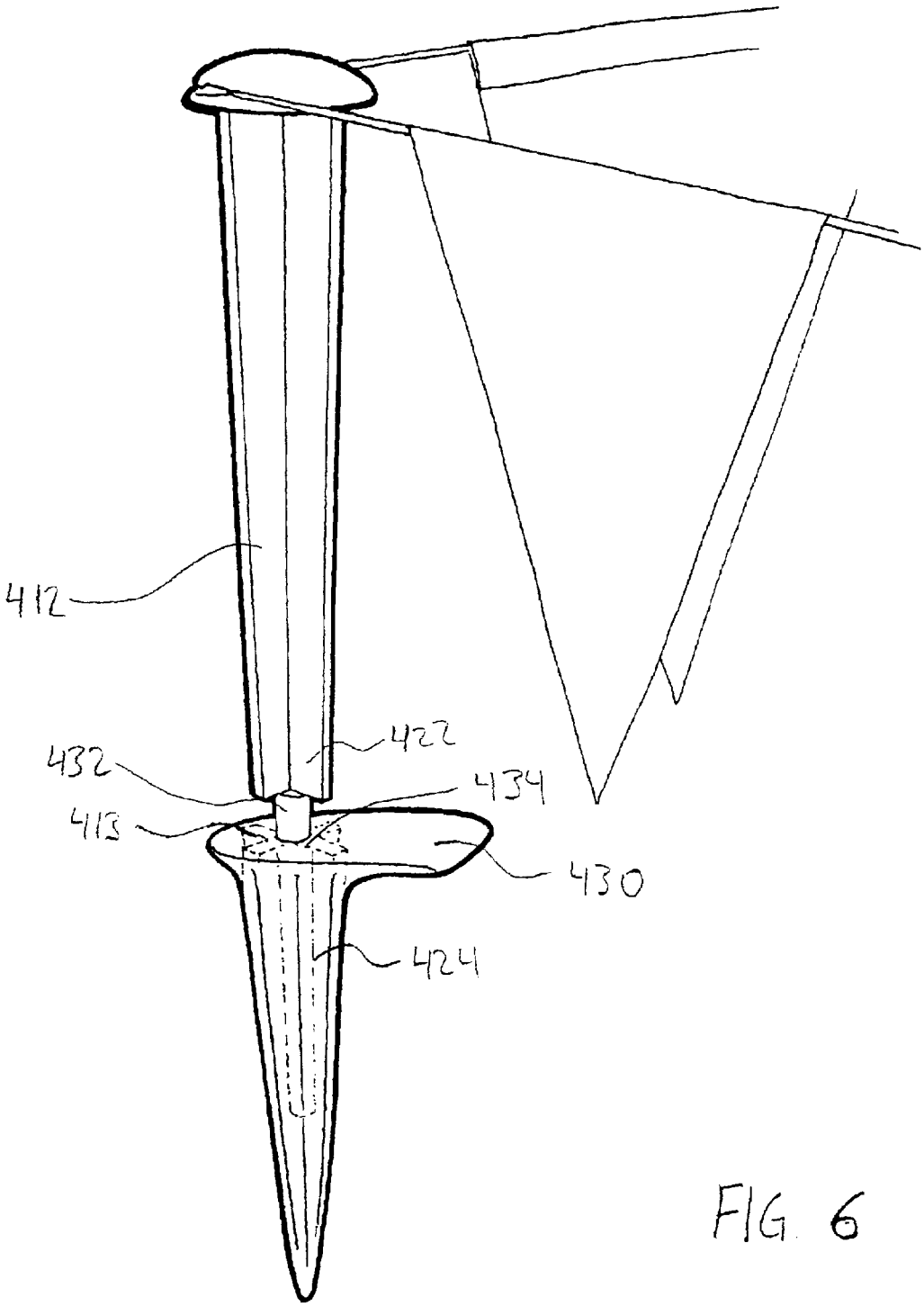
FIG. 6 is perspective view of an alternate embodiment of the invention, showing the connecting means secured to an alternate post.

In another preferred embodiment shown in FIG. 6, the post 412 has a two-piece construction with a separation point 413 between the intermediate portion 422 and the lower portion 424. A projection 432 extends from one of the intermediate 422 or the lower portion 424, and a receiver 434 is positioned in the other of the intermediate portion 422 or the lower portion 424. The projection 432 is adapted to be removably inserted in the receiver 434. Accordingly, the projection 432 and the receiver 434 are cooperatively dimensioned. The projection 432 can have a cylindrical or spine configuration. Preferably, the receiver 434 receives the entire length of the projection 432 to ensure the structural integrity of the post 412. Alternatively, the receiver 434 accommodates an extent of the length of the projection 432. The pedestal 430 can extend from either the lower portion 424 or the intermediate portion 422 depending upon design parameters of the post 412. The two-piece construction of the post 412 reduces the overall length of the post 412 thereby increasing the portability of the apparatus.

Figure 7:
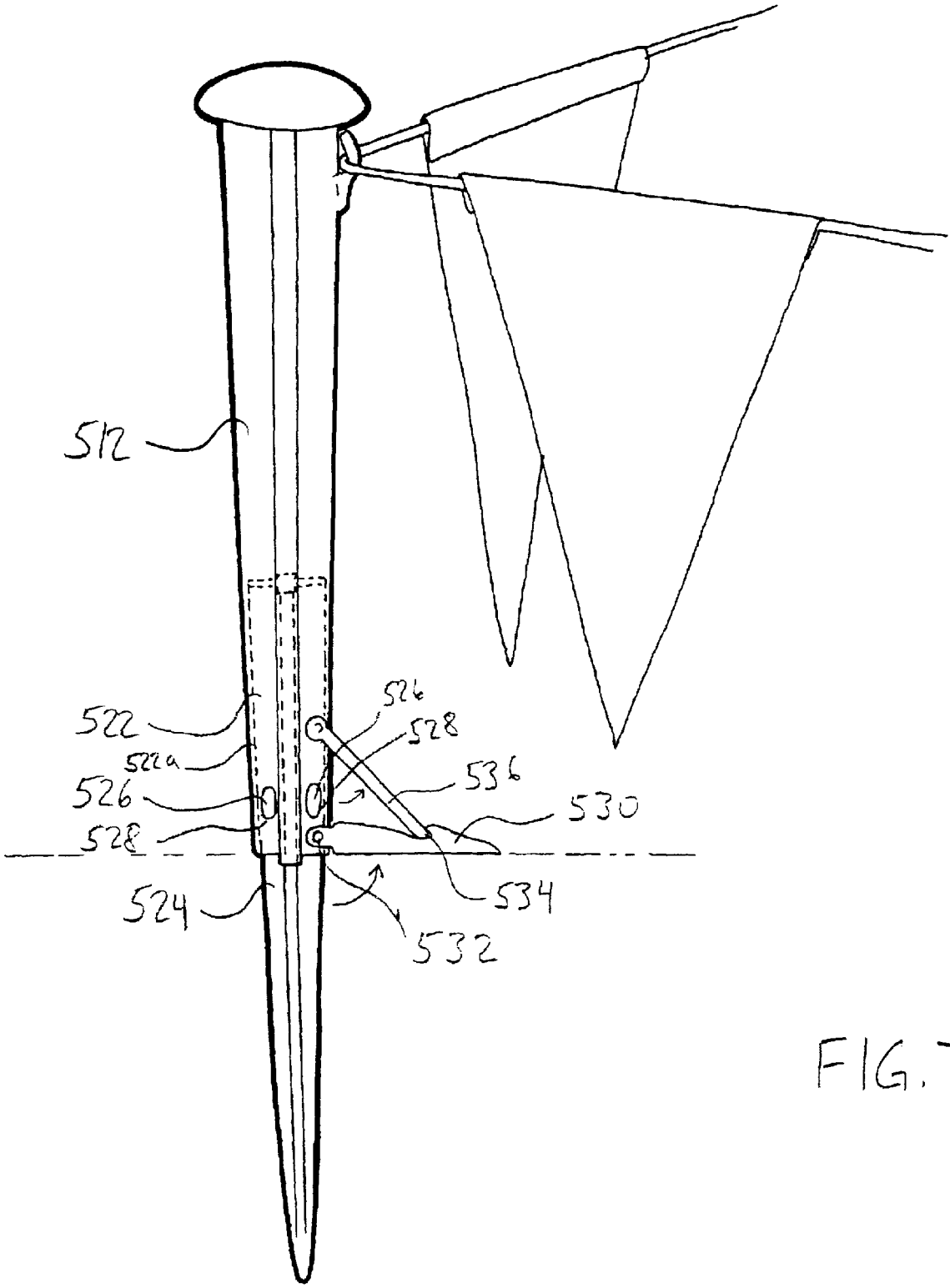
FIG. 7 is perspective view of an alternate embodiment of the invention, showing an alternate post.

In another preferred embodiment shown in FIG. 7, the post 512 has a two-piece design wherein a receiver 522*a* of the intermediate portion 522 receives an extent of the lower portion 524. Described in different terms, the intermediate and lower portions 522, 524 are cooperatively dimensioned such that the lower portion 524 is removably inserted in the intermediate portion 522. Alternatively, the intermediate and lower portions 522, 524 are cooperatively dimensioned such that the intermediate portion 522 is removably inserted in the lower portion 524. The lower portion 524 has at least one detent 526 which engages a recess 528 in the intermediate portion 522. Consequently, the detent 526 and the recess 528 are cooperatively positioned to engage each other when the post 512 is in the use position P1. In this manner, the engagement between the detent 526 and recess 528 secures the post 512 in the use position P1.

The post 512 further includes a pedestal 530 that is hingeably connected with a pin 532 to the post 512. A spring (not shown) can be utilized to bias the pedestal 530 to either a deployed position, wherein the pedestal 530 is generally perpendicular to the post 512, or a collapsed position, wherein the pedestal 530 is proximate the lower or intermediate portions 522, 524 of the post 512. A securing element 536 is adapted to secure the pedestal 530 in the use position P1 by engaging a notch 534 in the pedestal 530. The securing element 536 is hingeably connected to the intermediate portion 522.

Figure 8:
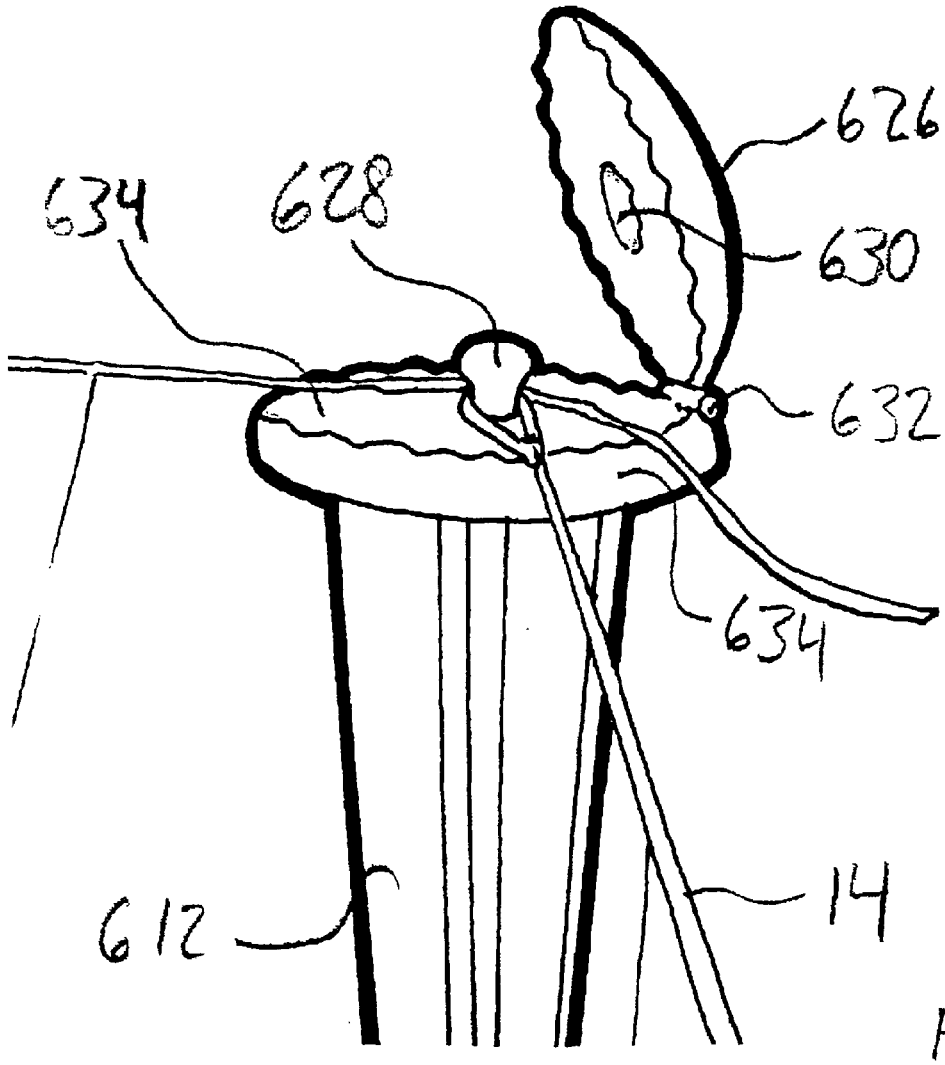
FIG. 8 is perspective view of an alternate embodiment of the invention, showing an alternate post.

In another preferred embodiment shown in FIG. 8, the upper portion 620 of the post 612 has a cap 626 that is hingeably connected to a base 34 with a hinge 632. The cap 626 functions as a cover and has an aperture 630 that mates with the receiving member 628. The receiving member or pin 628 extends vertically from an upper surface of the base 631. In an open position, the cap 626 is positioned above the base 634 thereby exposing the pin 628. In the open position, the first end 14*a* of the connecting means 14 can received by the pin 628 to be secured to the post 612. Also, a portion of the connecting means 14 can be positioned around the pin 628. The pin 628 and aperture 630 are cooperatively positioned to secure the connecting means 14 between the cover 626 and base 634 in a closed position In the closed position, a portion of the pin 628 is received by the aperture 630, thereby securing the cover 626 and securing the connecting means 14 between the cap 626 and the base 634. The connecting means 14 can be readily removed by opening the cover 626 and withdrawing the connecting means 14.

Figure 9:
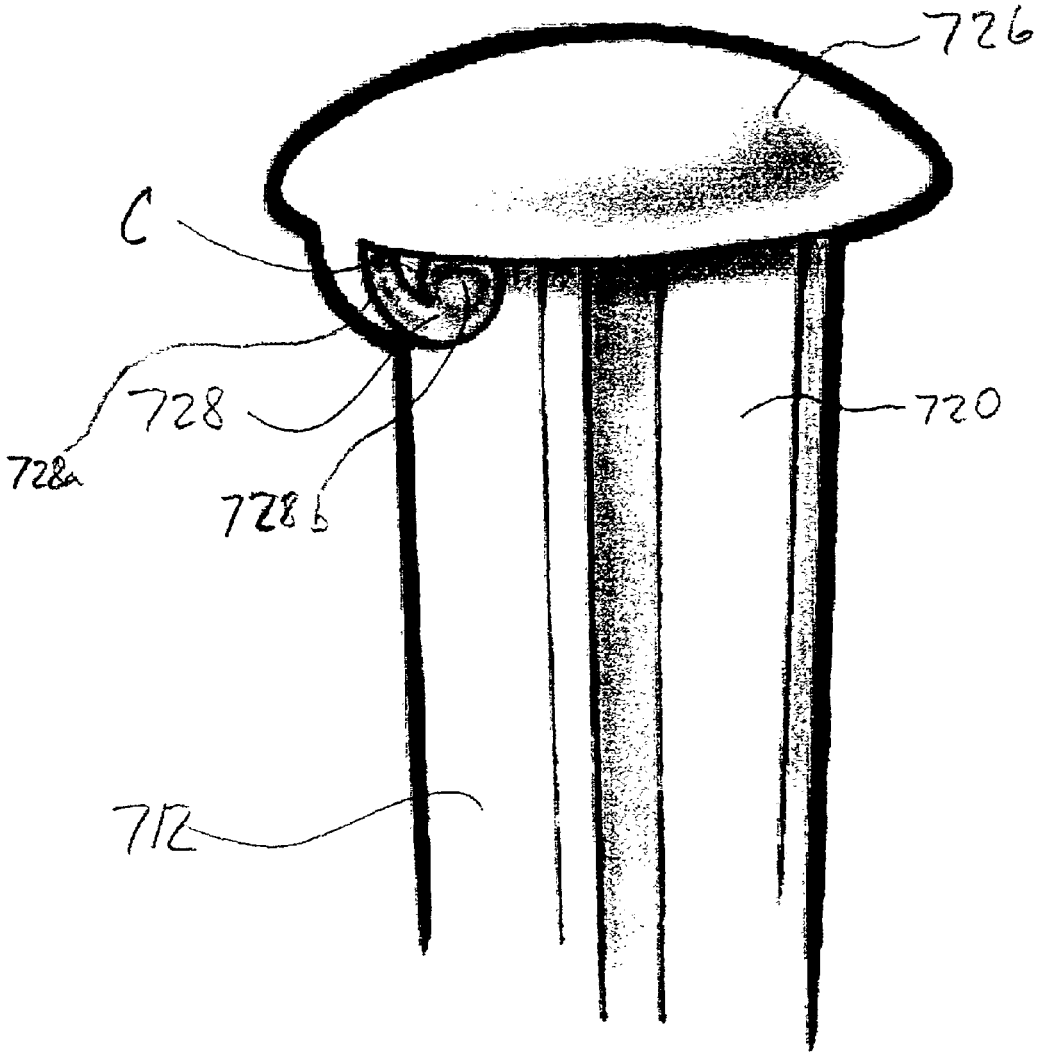
FIG. 9 is perspective view of an alternate embodiment of the invention, showing an alternate post; and, FIG. 10 is perspective view of an alternate embodiment of the invention, showing an alternate post.

In yet another embodiment shown in FIG. 9, the post 712 has a receiving member 728 adapted to secure the connecting means 14 between the receiving member 728 and the cap 726. The receiving member 728 has a curvilinear first portion 728*a* terminating at a second or bulb portion 728*b*. A portion of the connecting means 14 positioned in the clearance C and retained therein by the bulb 728*b* of the receiving member 728. The receiving member 728 is adapted to be flexible to facilitate the placement of the connecting means in the clearance C. The bulb 728*b* securely and efficiently retains the connecting means 14 without the need for tying or looping the connecting means 14 around the post 712.

Figure 10:
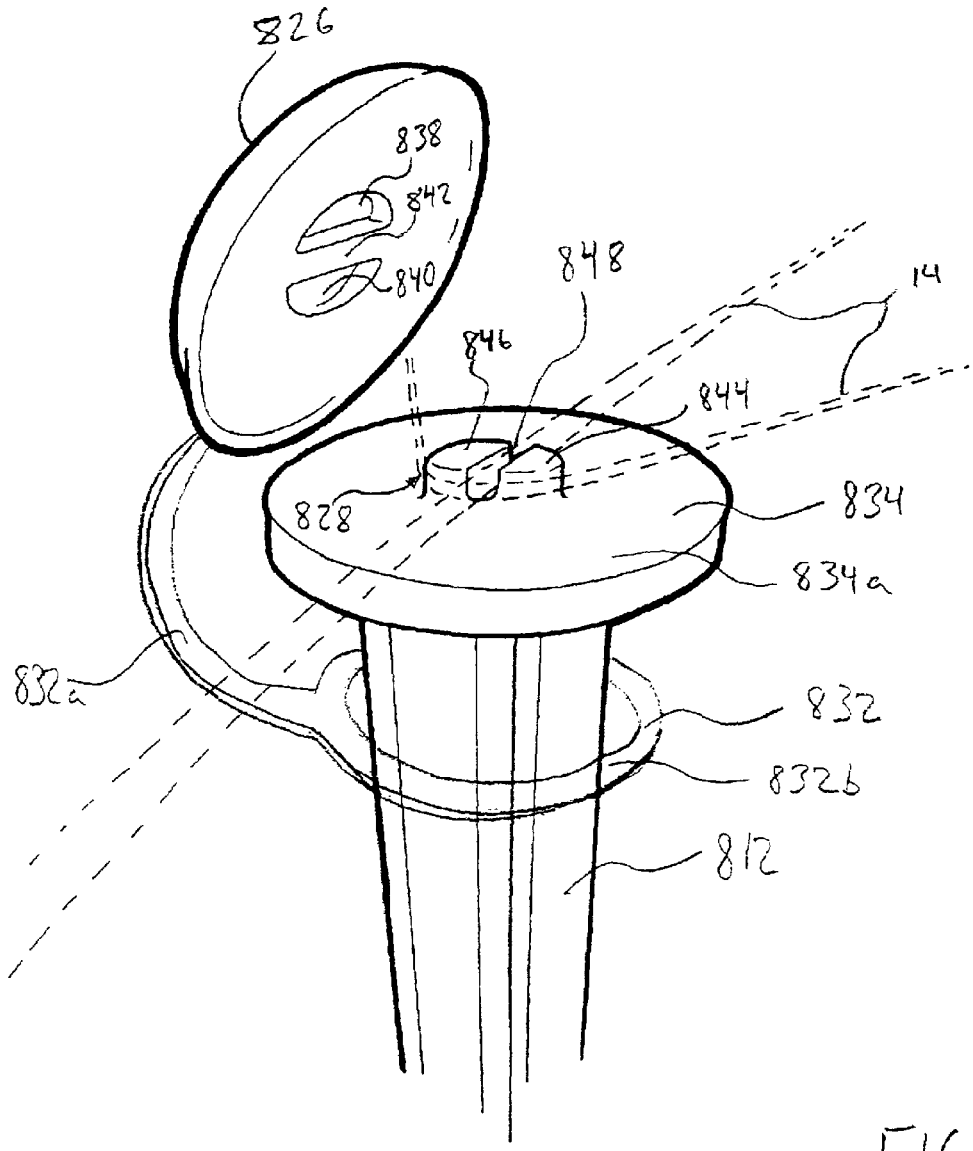

In yet another embodiment shown in FIG. 10, the cap 826 is removable and attachable to the base 834 of the post 812. The base 834 is configured to receive and secure the cap 826. The cap 826 has a receiving element 836 with a first recess 838 and a second recess 840 separated by a wall 842. The receiving member 828 extends from an upper surface 834*a*. The receiving member 828 has a first projection 844 and a second projection 846 separated by a channel 848. When the cap 826 engages the base 834, the first projection 844 is received by the first recess 838 and the second projection 846 is received by the second recess 840. Also, a portion of the wall 842 is received by the channel 848. The engagement between the wall 842 and the channel 848 secures the connecting means 14 between the cover 826 and the base 834. Accordingly, the wall 842, the channel 848, the first recess 838, the first projection 844, the second recess 840 and the second projection 846 are cooperatively dimensioned.

The post 812 can also include a tether 832 adapted to retain the cover 826 and prevent loss of the cover 826. The tether 832 includes an elongated portion 832*a* and a ring portion 832*b*, which is positioned about the post 812. The cap 826 is therefore connected to the post 812 even when detached from the base 834.

While the specific embodiment has been illustrated and described, numerous modifications come to mind without significantly departing from the spirit of the invention, and the scope of protection is only limited by the scope of the accompanying claims.

I claim:

1. A portable demarcation apparatus for establishing a boundary with respect to the ground, the apparatus comprising:

a plurality of posts adapted to be removably inserted into the ground, each post having a an upper portion and a lower portion, wherein the upper portion has a pin receiving member extending from the upper portion, wherein the upper portion further has a cap, the cap having an aperture and hingeably connected at a peripheral region to the upper portion of the post, wherein the pin is received in the aperture, wherein the lower portion has a pedestal adapted to facilitate the removable insertion of the post; and, a flexible connector element, a portion of the connector element releasably attached to each pin receiving member to define a perimeter.

2. The portable demarcation apparatus of claim 1, wherein the cap is moveable from a closed position wherein the pin is received by the aperture, to an open position wherein the pin is outboard of the aperture.

3. The portable demarcation apparatus of claim 1, wherein the cap and the upper portion are cooperatively positioned to secure the connecting means between them.

4. The portable demarcation apparatus of claim 1, wherein the post has a plurality of ribs extending between the upper portion and the lower portion.

* * * * *